US005418125A

United States Patent [19]

Maskasky

[11] Patent Number: 5,418,125

[45] Date of Patent: May 23, 1995

[54] GRAIN GROWTH PROCESS FOR THE PREPARATION OF HIGH BROMIDE ULTRATHIN TABULAR GRAIN EMULSIONS

[75] Inventor: Joe E. Maskasky, Rochester, N.Y.

[73] Assignee: Eastman Kodak Company, Rochester, N.Y.

[21] Appl. No.: 303,843

[22] Filed: Sep. 8, 1994

[51] Int. Cl.[6] ..... G03C 1/015; G03C 1/035; G03C 1/07

[52] U.S. Cl. ..... 430/569; 430/567; 430/600; 430/613

[58] Field of Search ..... 430/567, 569, 600, 613

[56] References Cited

U.S. PATENT DOCUMENTS

| | | | |
|---|---|---|---|
| 4,399,215 | 8/1983 | Wey | 430/567 |
| 4,400,463 | 8/1983 | Maskasky | 430/434 |
| 4,520,099 | 5/1985 | Akimura et al. | 430/613 |
| 4,713,323 | 12/1987 | Maskasky | 430/567 |
| 4,914,014 | 4/1990 | Daubendiek et al. | 430/569 |
| 5,217,858 | 6/1993 | Maskasky | 430/567 |
| 5,250,403 | 10/1993 | Antoniades et al. | 430/505 |
| 5,340,695 | 8/1994 | Yamaguchi | 430/264 |

FOREIGN PATENT DOCUMENTS

| | | |
|---|---|---|
| 0362699A3 | 4/1990 | European Pat. Off. . |
| 0503700A1 | 9/1992 | European Pat. Off. . |

*Primary Examiner*—Charles L. Bowers, Jr.
*Assistant Examiner*—Mark F. Huff
*Attorney, Agent, or Firm*—Carl O. Thomas

[57] ABSTRACT

A grain growth process is disclosed for providing an ultrathin tabular grain emulsion in which the average equivalent circular diameter of tabular grains is increased. An aqueous dispersion is provided containing high bromide grains having an average thickness of less or equal to that of the ultrathin tabular grains to be produced, the dispersion having a pH in the range of from 2 to 8 and a limited stoichiometric excess of bromide ions. An 8-hydroxyquinoline that contains at least one iodo substituent is introduced into the dispersing medium as a grain growth modifier. The aqueous dispersion containing the iodo-8-hydroxyquinoline grain growth modifier is held at 40° C. or a convenient higher temperature until greater than 50 percent of total grain projected area is accounted for by ultrathin tabular grains having {111} major faces of a higher average equivalent circular diameter than the starting grains and an average aspect ratio of at least 5.

18 Claims, 1 Drawing Sheet

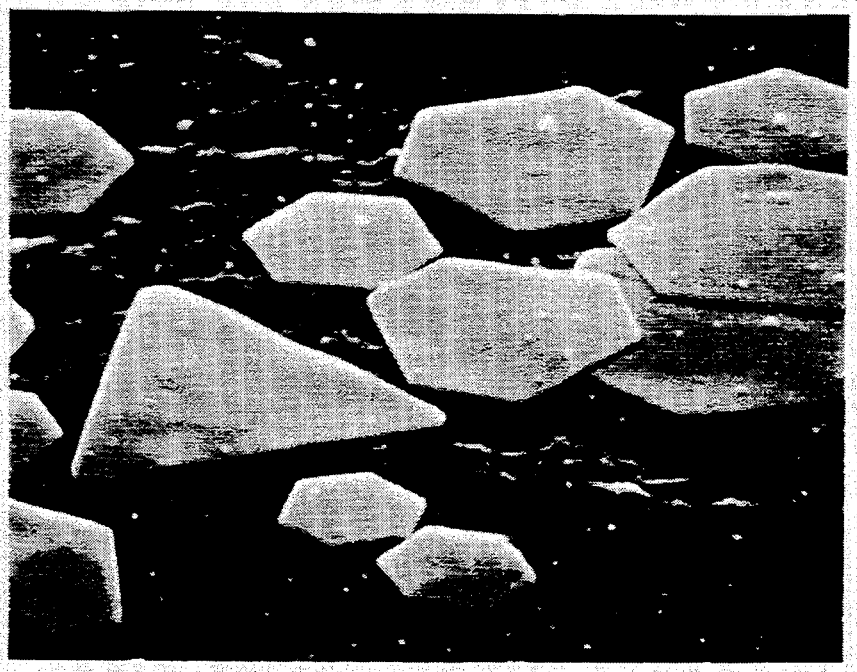
FIG. 1 1 μm
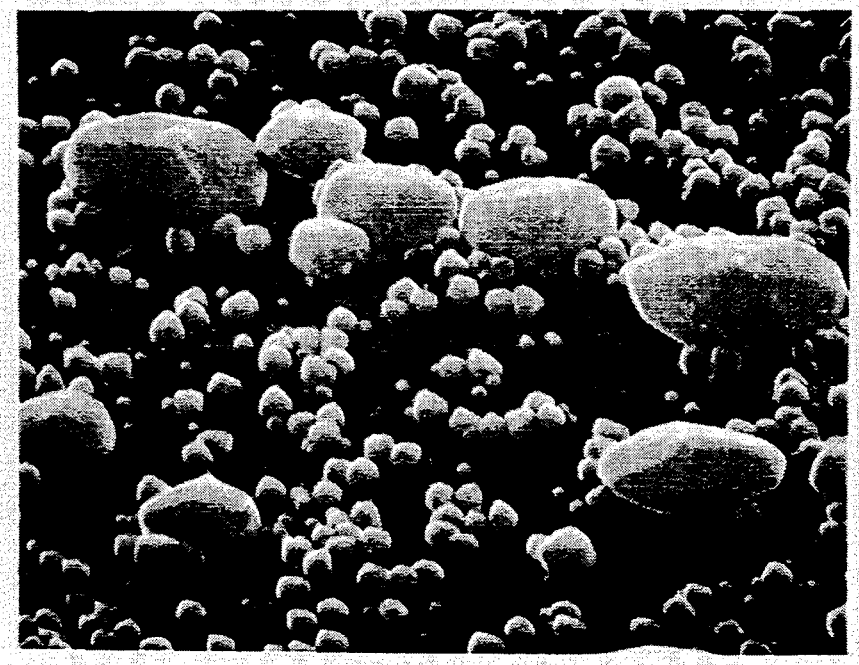
FIG. 2 1 μm
(Comparative)

GRAIN GROWTH PROCESS FOR THE PREPARATION OF HIGH BROMIDE ULTRATHIN TABULAR GRAIN EMULSIONS

FIELD OF THE INVENTION

The invention relates to a grain growth process for preparing ultrathin high bromide tabular grain emulsions for photographic use.

BACKGROUND OF THE INVENTION

The term "tabular grain" is employed to indicate a silver halide grain having an aspect ratio of at least 2, where "aspect ratio" is ECD/t, ECD being the equivalent circular diameter of the grain (the diameter of a circle having the same projected area as the grain) and t is the thickness of the grain.

The term "ultrathin tabular grain" is employed to indicate a tabular grain of a thickness less than 0.07 μm.

The term "tabular grain emulsion" is employed to indicate an emulsion in which tabular grains account for at least 50 percent of total grain projected area.

The term "high chloride" or "high bromide" as applied to a grain or emulsion is employed to indicate that the grain or the grains of the emulsions contain at least 50 mole percent chloride or bromide, respectively, based on total silver present in the grain or the grains of the emulsion.

The term "{111} tabular grain" is employed to indicate an emulsion in which the parallel major faces of the tabular grain lie in {111} crystal planes.

The first high chloride high aspect ratio (ECD/t>8){111} tabular grain emulsion is disclosed in Wey U.S. Pat. No. 4,399,215. The grains were relatively thick. Maskasky U.S. Pat. No. 4,400,463 (hereinafter designated Maskasky I) obtained thinner high chloride {111} tabular grains by employing an aminoazaindene (e.g., adenine) in combination with a synthetic peptizer having a thioether linkage. Maskasky U.S. Pat. No. 4,713,323 (hereinafter designated Maskasky II) produced thinner high chloride {111} tabular grains by employing the aminoazaindene grain growth modifier in combination with low methionine (<30 micromole per gram) gelatin, also referred to as "oxidized" gelatin, since the methionine concentration is reduced by employing a strong oxidizing agent, such as hydrogen peroxide.

High chloride ultrathin {111} tabular grain emulsions are disclosed in Maskasky U.S. Pat. No. 5,217,858 (hereinafter designated Maskasky III). Maskasky III discloses to be effective in preparing high chloride ultrathin {111} tabular grain emulsions triaminopyrimidine grain growth modifiers containing 4, 5 and 6 ring position amino substituents, with the 4 and 6 position substituents being hydroamino substituents. The term "hydroamino" designates an amino group containing at least one hydrogen substituent—i.e., a primary or secondary amino group. The triaminopyrimidine grain growth modifiers of Maskasky III include both those in which the three amino groups are independent (e.g., 4,5,6-triaminopyrimidine) and those in which the 5 position amino group shares a substituent with 4 or 6 position amino group to produce a bicyclic compound (e.g., adenine, 8-azaadenine, or 4-amino-7,8- dihydro-pteridine).

The process which Maskasky III employs to prepare high chloride ultrathin {111} tabular grain emulsions is a double jet process in which silver and chloride ions are concurrently run into a dispersing medium containing the grain growth modifier. The first function of the grain growth modifier is to promote twinning while grain nucleation is occurring, so that ultrathin grains can form. Thereafter the same grain growth modifier or another conventional grain growth modifier can be used to stabilize the {111} major faces of the high chloride tabular grains.

A common feature of the Maskasky high chloride {111} tabular grain emulsion precipitations is the presence of a grain growth modifier. The reason for this is that high chloride {111} tabular grains, unlike high bromide {111} tabular grains, cannot be formed or maintained in the absence of a grain growth modifier, but rather take nontabular forms, since {100} crystal faces are more stable in high chloride grains.

The art has long recognized that distinctly different techniques are required for preparing high chloride {111} tabular grain emulsions and high bromide {111} tabular grain emulsions. For example, Maskasky III does not disclose the processes of preparing high chloride ultrathin {111} tabular grain emulsions to be applicable to the preparation of high bromide ultrathin {111} tabular grain emulsions. Further, since at low pBr the {111} major faces of high bromide tabular grains have no tendency to revert to {100} crystal faces, the precipitation of high bromide {111} tabular grain emulsions has not required the addition of compounds comparable to the grain growth modifiers of Maskasky.

Daubendiek et al U.S. Pat. 4,914,014, Antoniades et al U.S. Pat. 5,250,403 and Zola et al EPO 0 362 699 illustrate the preparation of high bromide ultrathin {111} tabular grain emulsions. Each of the Examples resulting in the formation of ultrathin tabular grain emulsions are replete with adjustments undertaken during precipitation. Typical complexities include (a) different pBr conditions for grain nucleation and growth, (b) interruptions of the silver and/or halide salt additions, (c) frequent modifications of the rate of silver and/or halide salt additions, (d) the use of separate reaction vessels for grain nucleation and growth, thereby at least doubling the complexity of reaction vessel and control equipment, (e) the variance in dispersing medium volume as precipitation progresses, which makes optimized reaction vessel sizing for all phases of precipitation impossible, (f) dilution of emulsion silver content as precipitation progresses toward completion, thereby creating a water removal burden and increasing the required capacity of the reaction vessel, and (g) when pBr is maintained at customary low (e.g., pBr<1.5) values employed for precipitating high bromide {111} tabular grain emulsions, large excess amounts of soluble bromide salts must be discarded. Note that since pBr is the negative logarithm of bromide ion activity, bromide ion concentrations increase as pBr decreases. This is directly analogous to hydrogen ion activity increasing as pH decreases. None of Antoniades, Daubendiek et al and Zola et al suggest the use of any compound comparable to a grain growth modifier to prepare high bromide ultrathin {111} tabular grain emulsions.

Verbeeck EPO 0 503 700 discloses reduction of the coefficient of variation (COV) of high bromide high aspect ratio {111} tabular grain emulsions through the presence of an aminoazaindene, such as adenine, 4-aminopyrazolopyrimidine and substitutional derivatives, prior to the precipitation of 50 percent of the silver. Double jet precipitation techniques are employed. The minimum disclosed thickness of a tabular grain population is 0.15 μm.

Related Applications

Maskasky U.S. Ser. No. 195,807, filed Feb. 14, 1994, titled GRAIN GROWTH PROCESS FOR THE PREPARATION OF HIGH BROMIDE ULTRATHIN TABULAR GRAIN EMULSIONS, commonly assigned, (Maskasky V) discloses a process for the preparation of ultrathin high bromide tabular grain emulsions by ripening in the presence of a 4,5,6-triaminopyrimidine.

Maskasky U.S. Ser. No. 281,500, filed Jul. 27, 1994, titled A NOVEL CLASS OF GRAIN GROWTH MODIFIERS FOR THE PREPARATION OF HIGH CHLORIDE {111} TABULAR GRAIN EMULSIONS (I), commonly assigned, (Maskasky VI) discloses a process of preparing a high chloride {111} tabular grain emulsion in the presence of a grain growth modifier, which is an iodosubstituted 8-hydroxyquinoline.

BRIEF DESCRIPTION OF THE DRAWINGS

FIGS. 1 and 2 are scanning electron micrographs of grain structures viewed as a 60° angle.

FIG. 1 shows the ultrathin {111} tabular grains of the emulsion of Example 1 prepared according to the process of the invention.

FIG. 2 shows the nontabular grains produced by Emulsion 4B prepared by a process differing from the invention in substituting adenine as a grain growth modifier for an iodo-substituted 8-hydroxyquinoline.

SUMMARY OF THE INVENTION

In one aspect the invention is directed to a grain growth process for providing a tabular grain emulsion in which the average equivalent circular diameter of tabular grains is increased while maintaining their average thickness at less than 0.07 μm comprising introducing silver and halide ions into a dispersing medium in the presence of a grain growth modifier wherein tabular grains having an average thickness of less than 0.07 μm and a bromide content of greater than 50 mole percent are formed by (1) providing an aqueous dispersion containing at least 0.1 percent by weight silver in the form of silver halide grains containing at least 50 mole percent bromide having an average thickness of less than 0.06 μm, the dispersion having a pH in the range of from 2 to 8 and a stoichiometric excess of bromide ions to silver ions limited to a pBr of at least 1.5, (2) introducing into the dispersing medium as the grain growth modifier an iodo-substituted 8-hydroxyquinoline, and (3) holding the aqueous dispersion containing the grain growth modifier at a temperature of at least 40° C. until the average equivalent circular diameter of the grains in the dispersing medium is at least 0.1 μm greater than the average equivalent circular diameter of the grains provided in step (1) and greater than 50 percent of total grain projected area is accounted for by tabular grains having {111} major faces, an average aspect ratio of at least 5, and an average thickness of less than 0.07 μm.

The high bromide ultrathin {111} tabular grain emulsions prepared by the process of the invention produce high bromide ultrathin {111} tabular grain emulsions in which the tabular grains, as demonstrated in the Examples below, can account for >95 percent of total grain projected area. At the same time, the process itself offers significant advantages over the double jet processes heretofore reported for preparing high bromide ultrathin {111} tabular grain emulsions. All of the silver, halide and growth modifier can be present in the dispersing medium from the outset of grain growth. The volume of the reaction vessel can be constant and is almost always near constant throughout the growth process. The silver concentration levels can be relatively high. Water build up in the dispersing medium during the growth process does not occur and bromide ion concentration increases remain relatively small. A single reaction vessel can be employed for the growth process. Compared to the double jet procedures employed to prepare previously reported high bromide ultrathin {111} tabular grain emulsions it is apparent that the growth process of the invention is advantageous in allowing the use of simpler equipment, fewer controls, fewer and simpler manipulations, and the maintenance of higher silver concentrations in the dispersing medium, and in reducing halide ion effluent. Stated another way, all of the complexities (a) through (g) noted above can be either entirely obviated or significantly ameliorated.

DESCRIPTION OF PREFERRED EMBODIMENTS

To satisfy the objective of a high bromide ultrathin {111} tabular grain emulsion with an average tabular grain aspect ratio of at least 5 as an end product the grain growth process of the invention can be practiced starting with any conventional high bromide silver halide emulsion in which the average grain thickness is less than 0.06 μm. The starting emulsion can be either a tabular grain emulsion or a nontabular grain emulsion.

In one application of the grain growth process of the invention a high bromide {111} tabular grain emulsion having a mean grain thickness of less than 0.06 μm is chosen as a starting material. One practical incentive for discontinuing whatever conventional precipitation process that was employed to originate the starting tabular grain emulsion is that there are numerous conventional techniques for producing ultrathin tabular grains while the mean ECD of the grain population remains quite small, but, unfortunately, if grain growth is continued, the discrimination between surface and edge growth is insufficient to prevent tabular grain thickening beyond the ultrathin region. The grain growth process of the invention offers the advantage, demonstrated in the Examples below, that tabular grain ECD can be increased at a much higher rate than the thickness of the tabular grains. Under even the most adverse conditions an incremental increase in the ECD of the tabular grains at least 10 times greater than the incremental increase of their thickness can be realized. That is, at least a 0.1 μm increase in ECD can be realized by the growth process of the invention before a 0.01 μm increase in tabular grain thickness occurs. In fact, as demonstrated in the Examples below, extremely large increases in mean ECD in starting tabular grains can be realized while maintaining thickness increases well below 0.01 μm. From these demonstrations it is apparent that, if the starting tabular grains have an average thickness of less than 0.06 μm, it is possible to increase their mean ECD to any useful size. That is, mean ECD can be increased to 5 μm or even to the 10 μm commonly accepted maximum mean ECD useful limit for photographic purposes without exceeding the ultrathin average thickness limit of <0.07 μm. Since the grain growth process of the invention has the effect of increasing the percentage of total grain projected area accounted for by tabular grains, any high bromide tabular grain starting emulsion can be employed that satisfies the minimum projected area to satisfy the tabular grain emulsion definition (i.e., tabular grains accounting for at least 50 percent of total grain projected area).

To provide a specific illustration of how the grain growth process of the invention can be applied, attention is directed to Tsaur et al U.S. Pat. No. 5,210,013, which discloses the preparation of high bromide {111} tabular grain emulsions in which the COV is less than 10 percent and substantially all of the grain projected area is accounted for by tabular grains. Unfortunately, the process of preparation employed by Tsaur et al thickens the tabular grains. A minimum mean tabular grain thickness of 0.08 μm is disclosed. By initiating tabular grain emulsion preparation employing the process of Tsaur et al and then completing grain growth with the process of the present invention it is possible to initiate tabular grain preparation as taught by Tsaur et al while still obtaining an ultrathin tabular grain emulsion.

Another preferred approach that, together with the approach above, illustrates the breadth of the invention is to choose as a starting emulsion for the grain growth process a high bromide Lippmann emulsion. The term "Lippmann emulsion" has historically been applied to emulsions in which the grain sizes are too small to scatter visible light. Thus, the emulsions are visually identifiable in coatings as being nonturbid. A typical Lippmann emulsion grain size is around 500Å or less. The grain population is, of course, entirely nontabular. The Examples below demonstrate the practice of the invention starting with the precipitation of a Lippmann emulsion.

Having demonstrated the extremes of the starting grain populations to which the grain growth process can be applied, it is apparent that the grain growth process of the invention can also be practiced with intermediate starting emulsions. That is, so long as mean grain thickness remains less than 0.06 μm, it is immaterial whether the grains in the starting emulsion are entirely nontabular (all grains having aspect ratios of less than 2), entirely tabular or a mixture of both. Conventional emulsion preparation processes that produce fine nontabular grains or ultrathin tabular grains can be employed without modification while precipitation processes that would otherwise produce grains exceeding the 0.06 μm grain mean thickness parameter can simply be brought to an earlier termination to stay within this grain size limit.

The grains provided by the starting emulsion can be pure bromide or can contain minor amounts of chloride and/or iodide. Silver chloride can be present in the high bromide starting grains in any concentration up to, but less than 50 mole percent. The incorporation of chloride in high bromide starting grains can be used to reduce native blue sensitivity and to increase photographic development rates. Preferred chloride ion concentration levels in the starting grains are less than 25 mole percent. The solubility limit of iodide ions in silver bromide varies, depending upon precipitation conditions, but is rarely greater than 40 mole percent, while typical iodide concentrations in photographic emulsions are less than 20 mole percent. Extremely low levels of iodide in silver bromide, as low as 0.01 mole percent, can produce detectable increases in photographic sensitivity. Since iodide slows photographic processing rates and is not required in high concentrations to enhance photographic sensitivity, it is usually preferred to limit the iodide content of the starting grains to less than 10 mole percent and, for rapid processing applications, to less than 5 mole percent. The starting grains can be silver bromide, silver iodobromide, silver chlorobromide, silver iodochlorobromide or silver chloroiodobromide grains, where halides are named in order of ascending concentrations. It is also possible to introduce each different halide in a separate grain population. For example, the iodide ions can be supplied by introducing with silver bromide grains a separate silver iodide Lippmann emulsion. As grain growth occurs grains emerge that contain the desired mixture of halides. By timing the addition of a separate halide it is also possible to control the profile of that halide within the grains being grown.

The starting grains, apart from the required features described above, can take any convenient conventional form.

Starting with a conventional high bromide emulsion of the type described above an aqueous dispersion is prepared containing at least 0.1 percent by weight silver, based on total weight, supplied by the starting emulsion. The weight of silver in the dispersing medium can range up to 20 percent by weight, based on total weight, but is preferably in the range of from 0.5 to 10 percent by weight, based on the total weight of the dispersion.

The aqueous dispersion also receives the water and peptizer that are present with the grains in the starting emulsion. The peptizer typically constitutes from about 1 to 6 percent by weight, based on the total weight of the aqueous dispersion. In the simplest mode of practicing the invention, the grain growth process of the invention is undertaken promptly upon completing precipitation of the starting grain emulsion, and only minimum required adjustments of the dispersing medium of the starting grain emulsion are undertaken to satisfy the aqueous dispersion requirements of the grain growth process. This is particularly advantageous where the starting grains are susceptible to ripening, as in a Lippmann emulsion. Where the stability of the precipitated starting grain population permits, intermediate steps, such as washing, prior to commencing the grain growth process are not precluded.

The pH of the aqueous dispersion employed in the grain growth process is in the range of from 2 to 8, preferably 3 to 7. Adjustment of pH, if required, can be undertaken using a strong mineral base, such as an alkali hydroxide, or a strong mineral acid, such as nitric acid or sulfuric acid. If the pH is adjusted to the basic side of neutrality, the use of ammonium hydroxide should be avoided, since under alkaline conditions the ammonium ion acts as a ripening agent and will increase grain thickness.

To minimize the risk of elevated minimum densities in the emulsions prepared, it is common practice to prepare photographic emulsions with a slight stoichiometric excess of bromide ion present. At equilibrium the following relationship exists:

$$-\log K_{sp} = pBr + pAg \quad \text{(I)}$$

where $K_{sp}$ is the solubility product constant of silver bromide;

pBr is the negative logarithm of bromide ion activity; and pAg is the negative logarithm of silver ion activity. The solubility product constant of silver bromide emulsions in the temperature range of from 0° to 100° C. has been published by Mees and James *The Theory of the Photographic Process*, 3th Ed., Macmillan, N.Y., 1966, page 6. The equivalence point, pBr=pAg=−log $K_{sp}$+2, which is the point at which no stoichiometric excess of bromide ion is present in the aqueous dispersion, is known from the solubility product constant. By employing a reference electrode and a sensing electrode, such as a silver ion or bromide ion sensing electrode or both, it is possible to determine from the potential measurement of the aqueous dispersion its bromide ion content (pBr). Lin et al U.S. Pat. No. 5,317,521 is cited to show electrode selections and techniques for monitoring pBr. To avoid unnecessarily high bromide ion concentrations in the aqueous dispersion (and hence unnecessary waste of materials) the pBr of the aqueous dispersion is adjusted to at least 1.5, preferably at least 2.0 and optimally greater than 2.6. Soluble bromide salt (e.g. alkali bromide) addition can be used to decrease pBr while soluble silver salt (e.g. silver nitrate) additions can be used to increase pBr.

To the aqueous dispersion, either before, during or following the pBr and pH adjustments indicated, is added an 8-hydroxyquinoline containing at least one iodo substituent, hereinafter also referred to as iodo-substituted 8 hydroxyquiline or iodo-8hydroxyquinoline.

The required iodo substituent can occupy any synthetically convenient ring position of the 8-hydroxyquinolines. When the 8-hydroxyquinoline ring is not otherwise substituted, the most active sites for introduction of a single iodo substituent are the 5 and 7 ring positions, with the 7 ring position being the preferred substitution site. Thus, when the 8-hydroxyquinoline contains two iodo substituents, they are typically located at the 5 and 7 ring positions. When the 5 and 7 ring positions have been previously substituted, iodo substitution can take place at other ring positions.

Further ring substitutions are not required, but can occur at any of the remaining ring positions. Strongly electron withdrawing substituents, such as other halides, pseudohalides (e.g., cyano, thiocyanato, isocyanato, etc.), carboxy (including the free acid, its salt or an ester), sulfo (including the free acid, its salt or an ester), α-haloalkyl, and the like, and mildly electron withdrawing or electron donating substituents, such as alkyl, alkoxy, aryl and the like, are common at a variety of ring positions on both of the fused rings of the 8-hydroxyquinolines.

Polar substituents, such as the carboxy and sulfo groups, can perform the advantageous function of increasing the solubility of the iodo-substituted 8-hydroxyquinoline in the aqueous dispersing media employed for emulsion precipitation.

In one specifically preferred form the iodo-8-hydroxyquinolines satisfy the following formula:

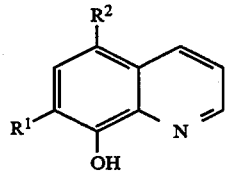

(I)

where $R^1$ and $R^2$ are chosen from among hydrogen, polar substituents, particularly carboxy and sulfo substituents, and strongly electron withdrawing substituents, particularly halo and pseudohalo substituents, with the proviso that at least one of $R^1$ and $R^2$ is iodo.

The following constitute specific illustrations of iodo-substituted 8-hydroxyquinoline grain growth modifiers contemplated for use in the practice of the invention:

| | |
|---|---|
| GGM-1 | 5-Chloro-8-hyroxy-7-iodoquinoline |
| GGM-2 | 8-Hydroxy-7-iodo-2-methylquinoline |
| GGM-3 | 4-Ethyl-8-hydroxy-7-iodoquinoline |
| GGM-4 | 5-Bromo-8-hydroxy-7-iodoquinoline |
| GGM-5 | 5,7-Diiodo-8-hydroxyquinoline |
| GGM-6 | 8-Hydroxy-7-iodo-5-quinolinesulfonic acid |
| GGM-7 | 8-Hydroxy-7-iodo-5-quinolinecarboxylic acid |
| GGM-8 | 8-Hydroxy-7-iodo-5-iodomethylquinoline |
| GGM-9 | 8-Hydroxy-7-iodo-5-trichloromethyl-quinoline |
| GGM-10 | α-(8-Hydroxy-7-iodoquinoline)acetic acid |
| GGM-11 | 7-Cyano-8-hydroxy-5-iodoquinoline |
| GGM-12 | 8-Hydroxy-7-iodo-5-isocyanatoquinoline |

It is believed that the effectiveness of the grain growth modifier is attributable to its preferential absorption to the major faces of {111} tabular grains and its ability to preclude additional silver halide deposition on these surfaces. Actual observations indicate that the interactions between the various grain surfaces present in the aqueous dispersion and the grain growth modifier are, in fact, complex. For example, it is not understood why double jet precipitations employing the grain growth modifier are less effective than the grain growth process of the invention. Contemplated concentrations of the grain growth modifier for use in the grain growth process of the invention range from 0.1 to 500 millimoles per silver mole. A preferred grain growth modifier concentration is from 0.4 to 200 millimoles per silver mole, and an optimum grain growth modifier concentration is from 4 to 100 millimoles per silver mole.

Once the grain growth modifier has been introduced into the aqueous dispersion a high bromide ultrathin {111} tabular grain emulsion having an average tabular grain aspect ratio of at least 5 is produced by holding the aqueous dispersion at any convenient temperature known to be compatible with grain ripening. This can range from about 40° C. up to the highest temperatures conveniently employed in silver halide emulsion preparation, typically up to about 90° C. A preferred holding temperature is in the range of from about 40° to 80° C.

The holding period will vary widely, depending upon the starting grain population, the temperature of holding and the objective sought to be maintained. For example, starting with a high bromide ultrathin {111} tabular grain emulsion to provide the starting grain population with the objective of increasing mean ECD by a minimum 0.1 μm, a holding period of no more than a few minutes may be necessary in the 50° to 60° C. temperature range, with even shorter holding times being feasible at increased holding temperatures. In this instance virtually all of the tabular grains present in the starting emulsion act as seed grains for further grain growth and survive the holding period. On the other hand, if the starting grain population consists entirely of fine grains and the intention is to continue the growth process until no fine grains remain as such in the emulsion, holding periods can range from few minutes at the highest contemplated holding temperatures to overnight (16 to 24 hours) at 40° C. In this instance a small fraction of the fine grains present in the starting emulsion act as seed grains for the growth of tabular grains while the remainder of the grains are ripened out onto the seed grains. The holding period is generally comparable to run times employed in preparing high bromide ultrathin {111} tabular grain emulsions by double jet precipitation techniques when the temperatures employed are similar. The holding period can be shortened by the introduction into the aqueous dispersion of a ripening agent of a type known to be compatible with obtaining thin (less than 0.2 μm mean grain thickness) tabular grain emulsions, such as thiocyanate or thioether ripening agents.

The grain growth process of the present invention is capable of providing high bromide ultrathin {111} tabular grain emulsions having precisely selected mean ECD's and average tabular grain aspect ratios. The emulsions produced by the process of the invention typically have average aspect ratios of greater than 8 and, in specifically preferred forms, at least 12. The emulsions can also exhibit high levels of grain uniformity. Attaining emulsions in which the tabular grains account for greater than 70 percent of total grain projected area can be readily realized and, with typical starting grain populations, tabular grain projected areas accounting for greater than 90 percent of total grain projected area have been realized.

During their preparation and subsequently conventional adjustments of the photographic emulsions can be undertaken. Convenional features are summarized in *Research Disclosure*, Vol. 308, December 1989, Item 308119, the disclosure of which is here incorporated by reference. *Research Disclosure* is published by Kenneth Mason Publications, Ltd., Dudley House, 12 North St., Emsworth, Hampshire P010 7DQ, England.

Examples

The invention can be better appreciated by reference to the following specific embodiments.

Example 1

AgBr Ultrathin Tabular Grain Emulsion

To a vigorously stirred reaction vessel containing 50 g oxidized gelatin and 2L distilled water at 25° C. were added 300 mL of 2M $AgNO_3$ solution at a rate of 300 mL per min using two pumps and a 12-hole ring outlet. A 2M NaBr solution was simultaneously added at a rate needed to maintain a pBr of 3.82 using two pumps and a 12-hole ring outlet. The silver and bromide introducing ring outlets were mounted above and below a rotated stirring head, respectively.

To 90 g of the resulting emulsion at 25° C. were added 2 mL of a dimethylformamide solution containing a total of 4 mole per mole silver of 5,7- diiodo-8-hydroxyquinoline. The temperature was increased to 40° C. Then the pH was adjusted to 5.0 and the pBr to 3.38. The mixture was heated to 60° C. and the pH was adjusted to 5.0 and the pBr to 3.08. The emulsion was heated for 4 hr at 60° C., resulting in an AgBr ultrathin {111} tabular grain emulsion.

The resulting emulsion contained tabular grains having an average ECD of 2.5 μm, an average thickness of 0.05 μm, and an average aspect ratio of 50. The tabular grains accounted for greater than 95% of the total projected area of the emulsion grains. The emulsion is shown in FIG. 1. The emulsion is listed in Table I for ease of comparison.

Example 2

AgBr Ultrathin Tabular Grain Emulsion

This example was made similar to that of Example 1, except that the pH of the heated fine grains was maintained at 4.0.

The resulting emulsion contained tabular grains having an average ECD of 1.8 μm, an average thickness of 0.045 μm, and an average aspect ratio of 40. Tabular grains accounted for approximately 90% of the total grain projected area. The emulsion is listed in Table I for ease of comparison.

Example 3

AgBr Ultrathin Tabular Grain Emulsion

To a vigorously stirred reaction vessel containing 50 g oxidized gelatin and 2 L distilled water at 25° C. was added 300 mL of 2M $AgNO_3$ solution at a rate of 300 mL per min. using two pumps and a 12-hole ring outlet. A 2M NaBr solution was simultaneously added at a rate needed to maintain a pBr of 3.82 using two pumps and a 12-hole ring outlet. The ring outlets were mounted above and below a rotated stirring head as in Example 1.

To 90 g of the resulting fine grain emulsion at 25° C. were added 8 mL of an aqueous solution containing 4 mmole per mole Ag of 8-hydroxy-7-iodo-5-quinolinesulfonic acid. The temperature of the emulsion was increased to 40° C., then the pH was adjusted to 4.0 and the pBr to 3.38. The mixture was heated to 60° C., and the pH and pBr were adjusted to 4.0 and 3.08, respectively. The emulsion was then held for 4 hours, resulting in a tabular grain emulsion.

The resulting emulsion consisted of tabular grains having an average diameter of 2.0 μm, an average thickness of 0.05 μm, and an average aspect ratio of 40. The tabular grains accounted for 90 percent of total grain projected area. The emulsion is listed in Table I for ease of comparison.

Comparative Example 4

Emulsion A. Fine Grain AgBr Emulsion

To a stirred reaction vessel containing 2 L of 5 wt % gelatin at 35° C. were added 2M $AgN_3$ solution and 2M NaBr solution. The $AgNO_3$ solution was added at 300 mL/min, and the NaBr solution was added as needed to maintain a pBr of 3.63. A total of 0.6 mole of $AgNO_3$ was added.

Emulsion B. AgBr Tabular Seed Grain Emulsion

To a stirred reaction vessel containing 7.5 g of oxidized gelatin, 1.39 g NaBr, and distilled water to 2 L at 35° C. and pH 2.0, 10 mL of 2M $AgN_3$ solution were added at 50 mL/min. Concurrently, 2M NaBr solution was added to maintain a pBr of 2.21. The temperature was increased to 60° C. at a rate of 5° C. per 3 min. Then 150 mL of a 33% by weight oxidized gelatin solution at 60° C. were added. The pH was adjusted to 6.0, and 14 mL of a 2M NaBr solution were added. At 60° C. and pH 06.0, 500 mL of a 2M $AgNO_3$ solution were added at 20 mL/min. Concurrently, 2M NaBr solution was added to maintain a pBr of 1.76. The resulting tabular grain seeds were 1.3 μm in diameter and 0.04 μm in thickness.

Testing Potential Tabular Grain Growth Modifiers

At 40° C. to 0.021 mole Emulsion A was added with stirring 0.0032 mole Emulsion B. The pBr was adjusted to 3.55. A solution of the potential tabular grain growth modifier was added in the amount of 7.0 mmole/mole Ag. The mixture was adjusted to a pH of 6.0 then heated to 70° C. and the pH was again adjusted to 6.0. After heating for 17 hr at 70° C., the resulting emulsions were examined for ultrathin tabular grains by optical and electron microscopy to determine mean grain diameter and thickness. The compounds tested for utility as grain growth modifiers in the production of ultrathin grains and the results are provided in Table I.

TABLE I

| Emulsion | Potential Tabular Grain Growth Modifier | Average {111} Tabular Grain Dimensions (μm) | % Projected Area as Nontabular Grains | % Projected Area as {111} Tabular Grains |
|---|---|---|---|---|
| Example 1 | 5,7-diiodo-8-hydroxy quinoline | 2.5 × 0.05 | <5% | >95% |
| Example 2 | 5,7-diiodo-8-hydroxy quinoline | 1.8 × 0.045 | 10% | 90% |
| Example 3 | 8-hydroxy-7-iodo-5-quinolinesulfonic acid | 2.0 × 0.05 | 10% | 90% |
| Control 4A | none | 1.7 × 0.18 | 40% | 60% |
| Control 4B | adenine | None | 100% | 0% |
| Control 4C | 4,5,6-triaminopyrimidine | 4.3 × 0.042 | <5% | >95% |
| Control 4D | xanthine | 1.3 × 0.20 | 60% | 40% |
| Control 4E | 4-aminopyrazolo [3,4-d]-pyrimidine | 2.0 × 0.20 | 10% | 90% |

As the above results show, only Example emulsions 1, 2 and 3 and Control Emulsion 4C (4,5,6-triaminopyrimidine) yielded an ultrathin tabular grain emulsion. Control Emulsion 4A, with no added tabular grain growth modifier, resulting in only minor lateral growth and significant thickness growth. Control 4B (adenine) yielded nontabular grains, including large grains lacking {111} major faces, shown in FIG. 2.

The invention has been described in detail with particular reference to preferred embodiments thereof, but it will be understood that variations and modifications can be effected within the spirit and scope of the invention.

What is claimed is:

1. A grain growth process for providing a tabular grain emulsion in which the average equivalent circular diameter of tabular grains is increased while maintaining their average thickness at less than 0.07 μm comprising introducing silver and halide ions into a dispersing medium in the presence of a grain growth modifier wherein tabular grains having an average thickness of less than 0.07 μm and a bromide content of greater than 50 mole percent are formed by (1) providing an aqueous dispersion containing at least 0.1 percent by weight silver in the form of silver halide grains containing at least 50 mole percent bromide having an average thickness of less than 0.06 μm, the dispersion having a pH in the range of from 2 to 8 and a stoichiometric excess of bromide ions to silver ions limited to a pBr of at least 1.5, (2) introducing into the dispersing medium as the grain growth modifier an 8-hydroxyquinoline containing at least one iodo substituent, and (3) holding the aqueous dispersion containing the grain growth modifier at a temperature of at least 40° C. until the average equivalent circular diameter of the grains in the dispersing medium is at least 0.1 μm greater than the average equivalent circular diameter of the grains provided in step (1) and greater than 50 percent of total grain projected area is accounted for by tabular grains having {111} major faces, an average aspect ratio of at least 5, and an average thickness of less than 0.07 μm.

2. A grain growth process according to claim 1 wherein greater than 50 percent of the total grain projected area of the grains provided in step (1) is accounted for by tabular grains having {111} major faces.

3. A grain growth process according to claim 2 wherein the thickness of the tabular grains is increased by less than 0.01 μm in step (3).

4. A grain growth process according to claim 1 wherein greater than 50 percent of the total projected area of the grains provided in step (1) is accounted for by nontabular grains.

5. A grain growth process according to claim 4 wherein the grains provided in step (1) are provided by a Lippmann emulsion.

6. A grain growth process according to claim 1 wherein the grains provided in step (1) additionally contain iodide.

7. A grain growth process according to claim 1 wherein the grains provided in step (1) additionally contain chloride.

8. A grain growth process according claim 1 wherein the pH is in the range of from 3 to 7.

9. A grain growth process according to claim 1 wherein the 8-hydroxyquinoline contains a solubility enhancing substituent.

10. A grain growth process according to claim 1 wherein the 8-hydroxyquinoline satisfies the formula:

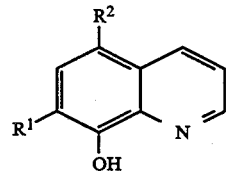

where $R^1$ and $R^2$ are chosen from among polar and halo substituents, with the proviso that at least one of $R^1$ and $R^2$ is iodo.

11. A grain growth process according to claim 10 wherein the polar substituent is a carboxy or sulfo substituent.

12. A grain growth process according to claim 10 wherein each of $R^1$ and $R^2$ are halo substituents.

13. A grain growth process according to claim 10 wherein one of $R^1$ and $R^2$ are each an iodo substituent.

14. A grain growth process according to claim 1 wherein the 8-hydroxyquinoline is present in the aqueous dispersion in a concentration ranging from 0.1 to 500 millimoles per silver mole.

15. A grain growth process according to claim 1 wherein the dispersing medium exhibits a pBr of at least 2.0.

16. A grain growth process according to claim 15 wherein the dispersing medium exhibits a pBr of greater than 2.6.

17. A grain growth process according to claim 1 wherein the dispersing medium contains from 0.1 to 20 weight percent silver.

18. A grain growth process according to claim 17 wherein the dispersing medium contains from 0.5 to 10 weight percent silver.

* * * * *